US006941849B1

(12) United States Patent
Bausela et al.

(10) Patent No.: US 6,941,849 B1
(45) Date of Patent: Sep. 13, 2005

(54) DEVICE FOR ADJUSTING THE PHASE OF PERFORATING DEVICES AS A FUNCTION OF THE FOLDING MODE

(75) Inventors: Franck Bausela, Creil (FR); Claude Duhamel, Mogneville (FR)

(73) Assignee: Goss International Montataire S.A., Montataire Cedex (FR)

( * ) Notice: Subject to any disclaimer, the term of this patent is extended or adjusted under 35 U.S.C. 154(b) by 511 days.

(21) Appl. No.: 09/626,312

(22) Filed: Jul. 26, 2000

(30) Foreign Application Priority Data

Jul. 26, 1999 (DE) ..... 199 35 022
Jan. 21, 2000 (FR) ..... 00 00775

(51) Int. Cl.[7] ..... B26D 1/28
(52) U.S. Cl. ..... 83/331; 83/332; 83/338
(58) Field of Search ..... 83/331, 338, 344, 83/304, 507, 674, 508.2, 663, 673, 504–502, 83/495, 332

(56) References Cited

U.S. PATENT DOCUMENTS 2,941,798 A * 6/1960 Harless ..... 270/72
3,641,857 A * 2/1972 Castle ..... 83/322
4,470,331 A * 9/1984 Eiting et al. ..... 83/344
4,598,638 A 7/1986 Fujii et al.
4,692,109 A * 9/1987 Hayashi et al. ..... 83/338
4,984,491 A * 1/1991 Bragaglia ..... 83/338
5,017,184 A * 5/1991 Takahori et al. ..... 83/343
5,048,387 A * 9/1991 Nitsuma et al. ..... 83/344
5,857,396 A * 1/1999 Strouse ..... 83/502
6,370,998 B1 * 4/2002 Yokoro et al. ..... 83/698.11

FOREIGN PATENT DOCUMENTS

CA 2181752 3/1997
EP 0 364 864 A2 4/1990

OTHER PUBLICATIONS

Japanese Patent Abstract No. 6-211424 (Yasutaka Ota), dated Aug. 2, 1994.

* cited by examiner

*Primary Examiner*—Allan N. Shoap
*Assistant Examiner*—Omar Flores Sánchez
(74) *Attorney, Agent, or Firm*—Laurennce A. Greenberg; Werner H. Stemer; Ralph E. Locher

(57) ABSTRACT

A device for perforating material webs by perforating tools accommodated on perforating cylinders and capable of producing perforations on copies in an exactly correct position with respect to cross-folds formed in the copies, the perforation position being adjustable during machine operation, the perforating tools being cooperatively related with associated perforating strips for producing transverse or cross-perforations, includes at least one perforating bar disposed coaxially with at least one of the perforating cylinders, the perforating tools and the perforating strips being accommodated on at least one of the perforating bars, the at least one of the perforating cylinders being adjustable relative to at least another of the perforating cylinders; a folder including the perforating device; and a pin-less folder including the perforating device.

17 Claims, 4 Drawing Sheets

DEVICE FOR ADJUSTING THE PHASE OF PERFORATING DEVICES AS A FUNCTION OF THE FOLDING MODE

BACKGROUND OF THE INVENTION

Field of the Invention

The invention relates to a device for adjusting the phase of perforating devices as a function of the folding mode, the device being accommodated, for example, in a folder disposed downline from a rotary printing machine.

In the prior art exemplified by the published Japanese Patent Document JP-Hei-6-211424, there is disclosed a perforating device for perforating tools in the folder of a rotary or web press. With the aid of the advancement in the art proposed therein, a correction may be made of the deviation of the position of cross-perforations on the inner and outer side of folded copies, by the displacement relative to a perforation formed on the inside of the folded copy, of the position of a cross-perforation formed on the outside of the copy. For this purpose, a folding cylinder having a diameter threefold that of a standard printing-unit cylinder, i.e, a plate, blanket or impression cylinder, is provided in a folder, and the rotation thereof is transmitted to a cylinder having the standard or single diameter, a unit for changing the rotational angle being provided between the aforementioned cylinders. This unit comprises a first draw or pull-roller pair, a pick-up cylinder of single diameter, a further draw or pull-roller pair and, in addition, a double gear wheel constructed with a double diameter. By the use of a sprocket gear mechanism assigned to the perforating cylinder of single diameter, following the perforation of one side of the folded copy, the other side of the folded copy is provided with an offset relative to the cross-perforation first applied. In this configuration, no provision is made for adjusting the depth of perforation transversely with respect to the web travel direction, of the cylinders that accommodate the perforating tools.

The German Patent Document DE 43 27 446 A 1 discloses a device for cross-perforating. This is proposed for a folder which is equipped with two cross-folding devices. Provision is made for pairwise mutually cooperating perforating knives and perforating strips, respectively, on perforating cylinders. An adjustment of the device during the operation of the machine is effected via a perforating cylinder of bipartite construction and via a perforating cylinder of unipartite construction. Adjustment of all the perforating knives, respectively, in the correct position relative to the cross-folds, or of all the perforating knives and the perforating strips associated with the first cross-fold, and finally adjustment of all the perforating knives and all the perforating strips, is possible.

In order to adjust the cross-perforations, spur-toothed and helically-toothed gear wheels, respectively, which are displaceable relative to one another are accommodated in up to four gear-train planes on the side walls of the folder that accommodates the perforating device. This construction, on the one hand, takes up a great deal of installation space and, on the other hand, requires a great number of mechanical parts, not just gear wheels but also shafts, shaft bearings and keyed connections and clutches, having to be provided, which cause the outlay for the device to appear to be very high.

SUMMARY OF THE INVENTION

In view of the aforecited prior state of the art, it is an object of the invention to provide a device for adjusting the phase of perforating devices as a function of the folding mode having a construction that is kept significantly simpler than heretofore for adapting the position of the cross-perforation to the position of the cross-fold, while the machine is running, in a folder which is operatable in different folding modes.

With the foregoing and other objects in view, there is provided, in accordance with one aspect of the invention, a device for perforating material webs by perforating tools accommodated on perforating cylinders and capable of producing perforations on copies in an exactly correct position with respect to cross-folds formed in the copies, the perforation position being adjustable during machine operation, the perforating tools being cooperatively related with associated perforating strips for producing transverse or cross-perforations, comprising at least one perforating bar disposed coaxially with at least one of the perforating cylinders, the perforating tools and the perforating strips being accommodated on at least one of the perforating bars, the at least one of the perforating cylinders being adjustable relative to at least another of the perforating cylinders.

In accordance with another feature of the invention, the perforating bar is mounted on a cylinder shaft extending through the one perforating cylinder.

In accordance with a further feature of the invention, the one perforating bar is adjustable in a direction opposite to the direction of rotation of the one perforating cylinder.

In accordance with an added feature of the invention, a perforating tool and a perforating strip are accommodated stationarily on the periphery of the one perforating cylinder.

In accordance with an additional feature of the invention, a perforating tool is accommodated on the one perforating bar on the one perforating cylinder, and is cooperatively related with a perforating strip accommodated on the other cylinder which is located opposite the one cylinder.

In accordance with yet another feature of the invention, a perforating tool for a delta-folding mode is accommodated on the one perforating bar on the one perforating cylinder, and is cooperatively related with a perforating strip accommodated on the other cylinder which is located opposite the one cylinder.

In accordance with yet a further feature of the invention, a perforating tool is accommodated on another perforating bar on one of the perforating cylinders, and is cooperatively related with a perforating strip accommodated stationarily on the periphery on another of the perforating cylinders located opposite the one perforating cylinder.

In accordance with yet an added feature of the invention, the perforating strips are mounted on further perforating bars extending coaxially with respect to the perforating cylinders and adjustable relative thereto.

In accordance with yet an additional feature of the invention, the perforating device includes at least another perforating bar, the perforating bars being accommodated in mounting supports on cylinder shafts of the perforating cylinders.

In accordance with still another feature of the invention, the perforating cylinders have respective cylinder shafts, and transmission elements are included on the cylinder shafts, the transmission elements being actable upon by a common adjusting unit.

In accordance with still a further feature of the invention, the transmission elements are constructed as a coulisse or slotted guide.

In accordance with still an added feature of the invention, the transmission elements have at least one force transmission point.

In accordance with still an additional feature of the invention, the transmission elements have at least another force transmission point, the force transmission points being constructed as toothings.

In accordance with another feature of the invention, the perforating device includes, between the transmission elements of the perforating cylinders, a compensating device for permitting eccentric adjustment of one of a pair of the perforating cylinders relative to a perforating nip located therebetween.

In accordance with a further feature of the invention, the perforating device includes a stationary perforating cylinder and an adjustable perforating cylinder, a drive and a transmission element for the adjustable perforating cylinder, and an articulated connection between the drive for the adjustable perforating cylinder and the transmission element therefor.

In accordance with another aspect of the invention, there is provided a folder having a device for perforating material webs by perforating tools accommodated on perforating cylinders and capable of producing perforations on copies in an exactly correct position with respect to cross-folds formed in the copies, the perforation position being adjustable during machine operation, the perforating tools being cooperatively related with associated perforating strips for producing transverse or cross-perforations, comprising at least one perforating bar disposed coaxially with at least one of the perforating cylinders, the perforating tools and the perforating strips being accommodated on at least one of the perforating bars, the at least one of the perforating cylinders being adjustable relative to at least another of the perforating cylinders.

In accordance with a concomitant aspect of the invention, there is provided a pin-less folder having a device for perforating material webs by perforating tools accommodated on perforating cylinders and capable of producing perforations on copies in an exactly correct position with respect to cross-folds formed in the copies, the perforation position being adjustable during machine operation, the perforating tools being cooperatively related with associated perforating strips for producing transverse or cross-perforations, comprising at least one perforating bar disposed coaxially with at least one of the perforating cylinders, the perforating tools and the perforating strips being accommodated on at least one of the perforating bars, the at least one of the perforating cylinders being adjustable relative to at least another of the perforating cylinders.

Advantages which can be achieved by the features according to the invention are many and varied. On the one hand, mounting the perforating bars on the perforating cylinders permits considerable simplification of the adjusting device for changing the phase angle of the perforating bars during machine operation, relative to the perforating cylinder, and on the other hand, the drive of the perforating bars is considerably simplified. In addition, by the features proposed in accordance with the invention, the setting or adjustment of the perforating depth, i.e., the extent of penetration of the perforations, in particular for multi-layer material webs, can be simplified.

In an advantageous development of the idea upon which the invention is based, the perforating bars are accommodated on the cylinder shafts, respectively, extending through the perforating cylinders. One of the perforating bars can be adjusted in a direction opposite to the direction of rotation of the perforating cylinder, in order to take into account the different cross-fold positions on the copy which are set when the cross-fold mode is changed.

One perforating tool can be accommodated in a stationary manner or stationarily on the periphery of a perforating cylinder and can cooperate with a perforating strip that is likewise mounted in a stationary manner on the opposite cylinder. A perforating tool that can be rotated in the peripheral direction relative to the perforating cylinder can be accommodated on a first perforating bar also provided on the perforating cylinder. The aforementioned perforating tool cooperates with a perforating strip mounted in a stationary manner on the opposite cylinder, for example in order to produce a cross-perforation in the second cross-fold folding mode. The perforating bar can additionally accommodate a further perforating tool, which is intended to make the perforation in the delta fold folding mode, and makes perforations on folded spines of the delta fold formed in the copy.

In the perforating cylinder that is mounted so as to be adjustable relative to the perforating nip or gap, by contrast with a perforating cylinder mounted in a stationary manner, a further perforating bar can be accommodated, and cooperates with a perforating strip which is provided on the first-mentioned stationarily mounted perforating cylinder.

The perforating strips for delta fold and second cross-fold (double parallel fold), which are accommodated as standard stationarily on the perforating cylinders, can equally well also be accommodated on further perforating bars which are mounted coaxially with respect to the shafts of the perforating cylinders. In order to reduce the drive power of the setting or adjusting drive required for the relative adjustment of the perforating bars, the latter, which surround the perforating cylinder in a shell-like manner, can be accommodated in mounting supports on the cylinder shafts.

In a construction which advantageously avoids complete spur gear trains, the perforating bars can be adjusted via transmission elements which, as coulisses or slotted guides, are accommodated on the cylinder-shaft journals provided on the drive side of the perforating cylinders. The elements that transmit the adjustment travel may be provided very advantageously and in a manner which is convenient for production on the outer sides of the coulisses or slotted guides as an external toothing or toothing system which cooperates with corresponding toothings or toothing systems on the perforating bars, in order to achieve the relative positioning of the perforating bars that accommodate the perforating tools relative to the periphery of the perforating cylinders.

Because one of the perforating cylinders is adjustable in relation to the perforating nip or gap, in order to vary the perforation depth in the material webs between the perforating bridges which are operatable via a common adjusting unit, there is accommodated a compensating mechanism, which permits joint or in-common changing of the peripheral positions of the perforating bars on the cylinders without the geometry of the perforating nip or gap being adversely affected by the position of the adjustable perforating cylinder.

The perforating device according to the invention is suitable for use both in folders with sets of pins and in those without pins, both for job printing and also for newspaper printing.

Other features which are considered as characteristic for the invention are set forth in the appended claims.

Although the invention is illustrated and described herein as embodied in a device for adjusting the phase of perforating devices as a function of the folding mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
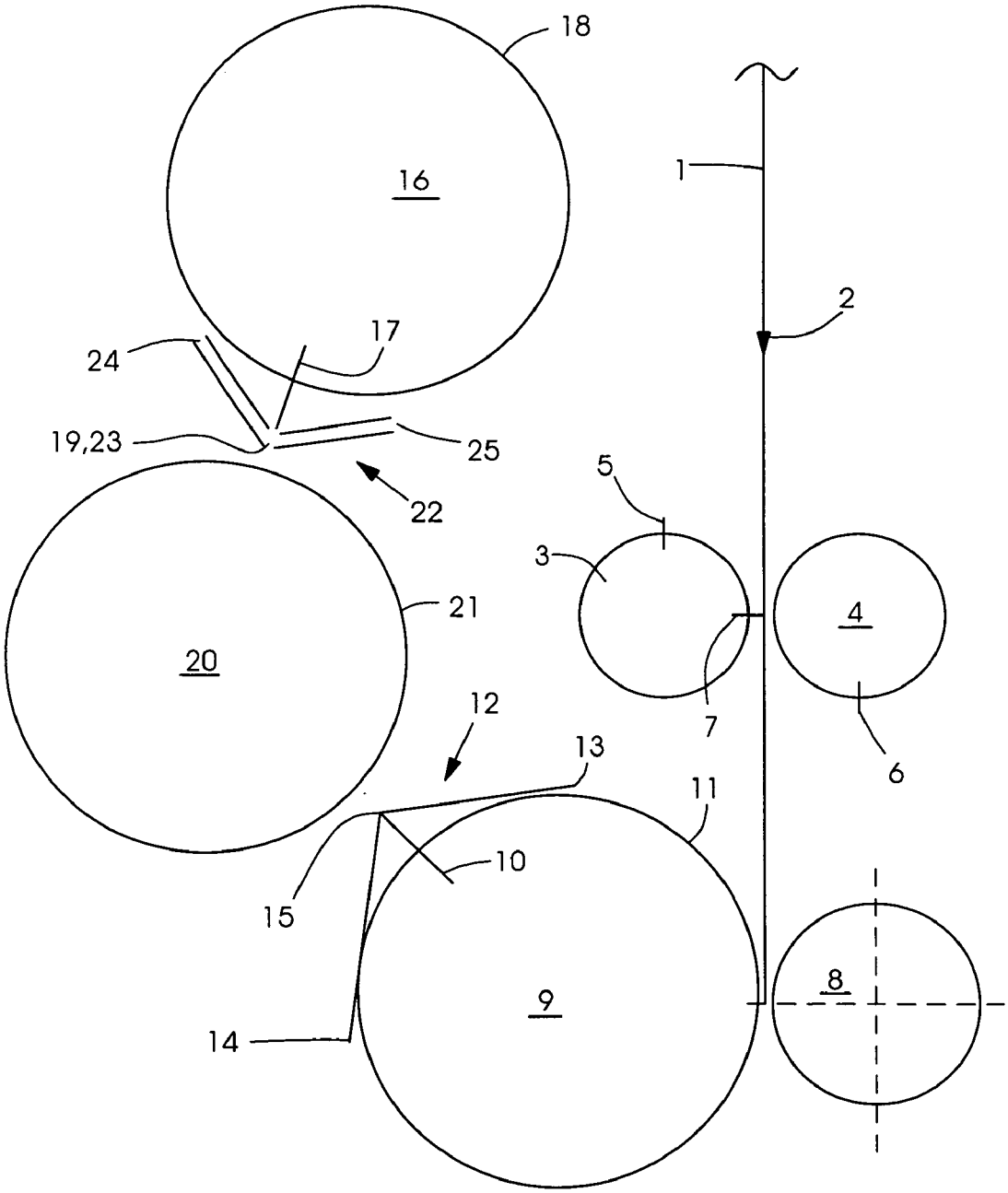
FIG. 1 is a diagrammatic and schematic front elevational view of a folder disposed downline from a rotary or web press and incorporating the phase adjusting device according to the invention, and showing the construction thereof and the sequence of cross-folding operations therein.

Referring now to the drawings and, first, particularly to FIG. 1 thereof, there is reproduced therein diagrammatically the construction of, and schematically the sequence of cross-folding operations in a folder. A printed material web 1 formed of a number of web layers runs vertically oriented into the folder in a web travel direction 2, the web 1 being perforated between mutually cooperating perforating cylinders 3 and 4 so that the perforations extending in a transverse direction of the material web 1 coincide with the positions of the cross-fold. A perforating tool 5 on the perforating cylinder 3, which is mounted stationarily, and a perforating tool 6 on the perforating cylinder 4, which is movable, serve for perforating the folded spines at the second cross-fold (double parallel fold), whereas the perforating tool 7 provided on the perforating cylinder 3, which is mounted stationarily, is provided for the first cross-fold. In the case of previous cross-perforating devices, resetting the perforating tools was possible only after the rotary or web press had been stopped and the adjustment had been performed.

After the perforation has been performed, copies 12 are cut from the end of the material web 1 leading in the web travel direction 2, the copies 12 being possibly formed of a number of individual layers lying above one another, depending upon the number of web strands accommodated in the material web 1. The copies 12 are accepted by the folding cylinder 9, transported on the peripheral surface 11 thereof and, due to activation of a folding blade 10, which moves out of the periphery 11 of the folding cylinder 9, are thrust into the folding jaws of a folding-jaw cylinder which is not otherwise specifically illustrated but cooperates with the folding cylinder 9. Accordingly, the folded spine 15 is produced between the ends 13 and 14 of the copy 12, which produces the first cross-fold or first parallel fold. By an otherwise not specifically illustrated transfer of the folded copies 12 to a further folding cylinder 16, that transfer of copies forming no part of the invention of the instant application, the respective copes 12 are accepted on the peripheral surface 18 of the further folding cylinder 16, and the second cross-fold is then formed by moving the folding blade 17 out and folding the copy 12 which has already been cross-folded once. This produces a double cross-folded copy 22 having ends 24 and 25, the folded spine 23 being formed at the second cross-fold (double parallel fold).

In the delta-folding mode, the copy is folded twice, as compared with the double parallel folding mode, but at different points, while in the case of the double parallel fold, depending upon the set overfold, a half-fold made at the first and second cross-fold is carried out on the copy 12, which produces a copy 22.

After cross-folding has been performed, be it in delta-folding mode or in double parallel folding mode, the copies 12, 22 folded in such a manner are transported by a transport cylinder 20 to a second longitudinal folding device, which may be provided if required, or directly brought to the delivery.

Figure 2:
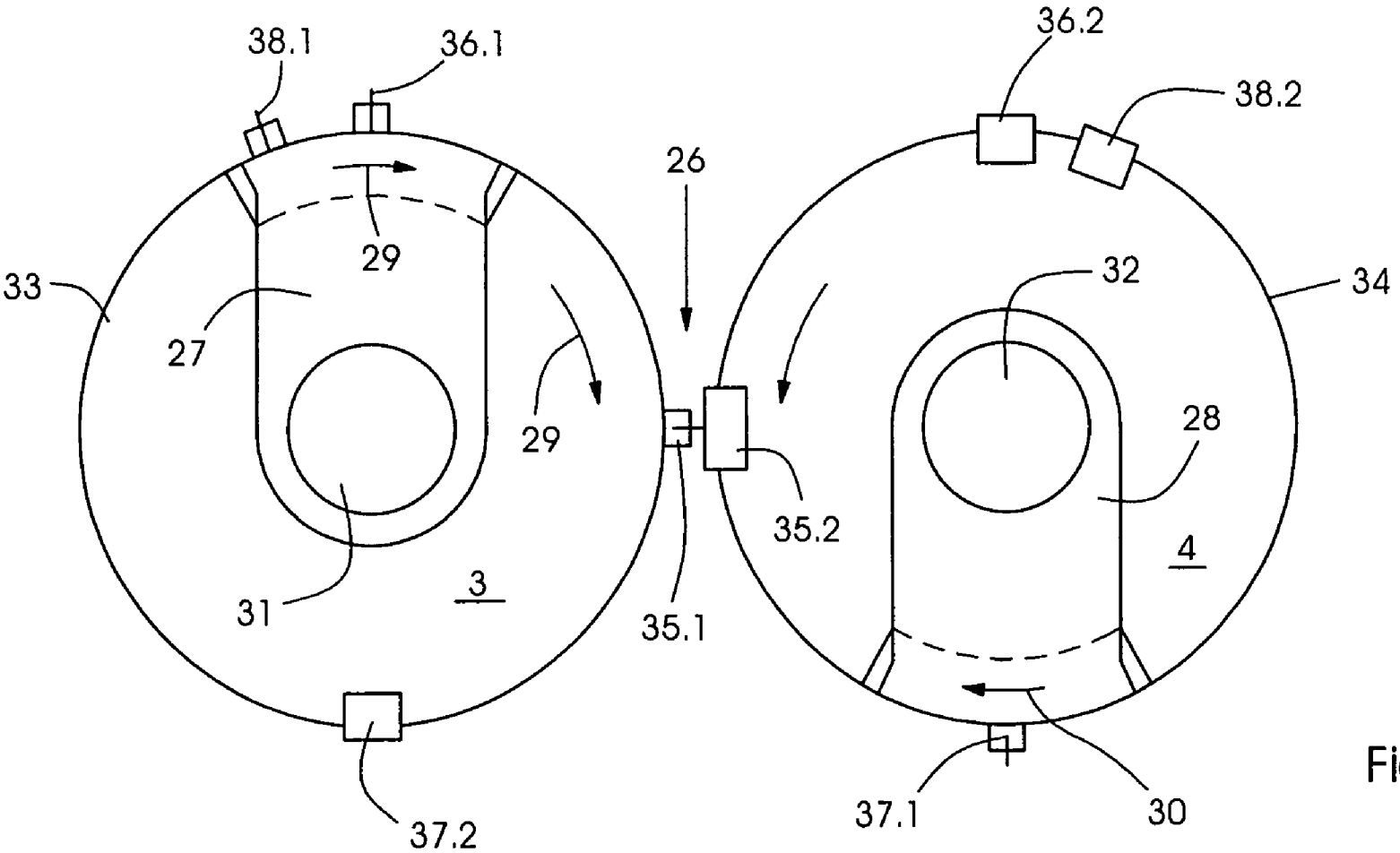
FIG. 2 is an enlarged fragmentary view of FIG. 1 showing a perforating-cylinder pair mutually cooperating in a perforating gap and having perforating bars accommodated coaxially with the respective cylinders.

FIG. 2 is a side view of a perforating-cylinder pair 3, 4, a perforating nip or gap 26 for the material web 1 that passes between the cylinders 3 and 4 of the perforating-cylinder pair 3, 4 being predefined between the peripheral surfaces 33 and 34 of the respective perforating cylinders 3 and 4. Depending upon the thickness of the material web 1 to be processed, the perforating cylinder 4 can be set closer to the periphery of the fixedly mounted perforating cylinder 3 or set farther away from the latter. Thereby, the penetration depth of the perforations to be produced in the web layers forming the material web 1 can be set and, if necessary or desirable, changed.

In the exemplary embodiment illustrated in FIG. 2, a respective perforating bar 27, 28 is provided for each perforating cylinder 3, 4, and extends coaxially with the respective cylinder shafts 31 and 32 of the perforating cylinders 3 and 4, variably positionable perforating tools being accommodated on the bars 27 and 28. For each perforating cylinder 3, 4, two perforating bars can also be provided, for which note the bars 27.1 and 28.1 in FIG. 4. Located on the perforating bars 27 and 28 illustrated in FIG. 2 are the perforating tools 38.1 for the delta fold and/or the perforating tool 36.1 for the second cross-fold. They cooperate with the perforating strips 36.2 for the second cross-fold and/or 38.2 for the delta fold, the strips being disposed in a stationary manner on the periphery 34 of the adjustably mounted perforating cylinder 4.

Stationarily accommodated on the respective periphery 33, 34 of the two perforating cylinders 3 and 4 are the perforating tools 35.1 and the perforating strip 35.2 cooperating therewith in order to form a perforation in the region of a first cross-fold on the copy. The perforating strip 37.2 cooperating in turn with the perforating tool 37.1 for the second cross-fold, which is accommodated on the further perforating bar 28, is stationary on the fixedly mounted perforating cylinder 3.

The perforating cylinder 3 rotates in the rotary direction represented by the arrow 29 in relation to the perforating nip or gap 26, while the adjustably mounted perforating cylinder 4 rotates in the same direction as the latter relative to the perforating nip or gap 26, so that a continuous web advance through the perforating nip or gap 26 is established. As referred to the peripheral surface 34 of the perforating cylinder 4, the perforating bar 28 is adjustable in the direction of rotation represented by the arrow 30 opposite to the direction of rotation of the perforating cylinder 4 represented by the associated unidentified curved arrow.

The perforating strips 36.2, 37.2 and 38.2, which are reproduced in FIG. 2 and arranged in a stationary manner, could also be accommodated on further perforating bars 27.1 and 28.1 (FIG. 4) which surround the respective peripheral surfaces 33 and 34 of the perforating cylinders 3 and 4 like shells, and could therefore likewise be relatively adjustable or alternatively adjustable, simultaneously with the perforating tools 36.1, 37.1 and 38.1 which are accommodated on the respective perforating bars 27 and 28.

Figure 3:
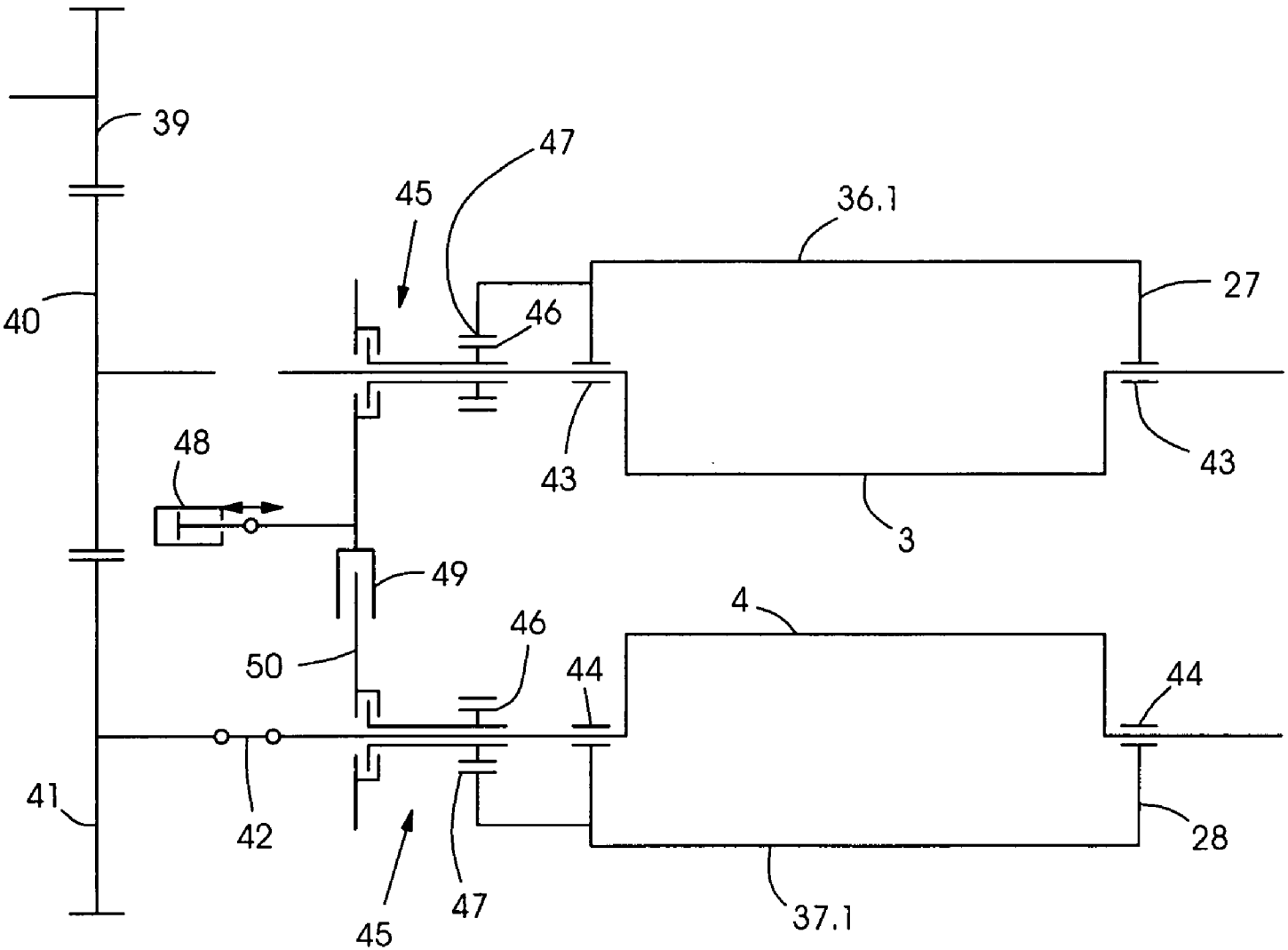
FIG. 3 is a fragmentary side elevational view of FIG. 1 showing the kinematics of a drive for perforating bars relative to the perforating-cylinder pair, the respective cylinders of the pair thereof having only one perforating bar at the periphery thereof.

FIG. 3 shows, in highly diagrammatic and schematic form, a drive configuration for the perforating bars 27 and 28 shell-like surrounding the respective perforating cylinders 3 and 4.

In the modified embodiment according to FIG. 3, a respective perforating cylinder 3, 4 is provided with one perforating bar 27, 28. The perforating bars 27 and 28 are accommodated in respective mounting supports 43 and 44 on cylinder journals of the respective cylinder shafts 31 and 32, and provided with toothing 47 which permits adjustment in the peripheral direction of the perforating cylinders 3 and 4. The toothing 47 meshes with external toothing 46 on a transmission element 45, which can be constructed as a coulisse or slotted guide that is displaceable or rotatable on the cylinder shaft 31 and 32, respectively.

Both coulisses or slot guides 45 on the cylinder shafts 31 and 32 are connected to an adjusting unit 48, with which the perforating bars 27 and 28 are adjustable relative to the peripheral surfaces 33 and 34 of the perforating cylinders 3 and 4, respectively. Due to the integration of a compensating unit 49 into the sliding guide 50 between the transmission elements 45 on the cylinder shafts 31 and 32, a change in the perforating nip or gap 26 can be achieved irrespective of the adjustment of the phase angles of the perforating bars 27 and 28 on the perforating cylinders 3 and 4 relative to one another. This is augmented by having the adjustable perforating cylinder 4 connected via a hinged shaft 42 to the drive gear 41 thereof, which in turn is driven by the drive gear 40 of the perforating cylinder 3. In view of the hinged shaft 42, the adjustable cylinder 4 can be adjusted relative to the perforating nip or gap 26 without any problem. The coulisses or slotted guides 45, which are connected to one another via the sliding guide 50 and the compensating unit 49, can be positioned jointly relative to one another, because the correct setting of the perforating tools 36.1 and 38.1 relative to the perforating strips 36.2 and 38.2, respectively, depending upon the folding mode must be assured. If the adjustment of the rotational position of one perforating bar is performed, the perforating bar accommodating perforating strips corresponding thereto is automatically adjusted as well, depending upon the folding mode.

Figure 4:
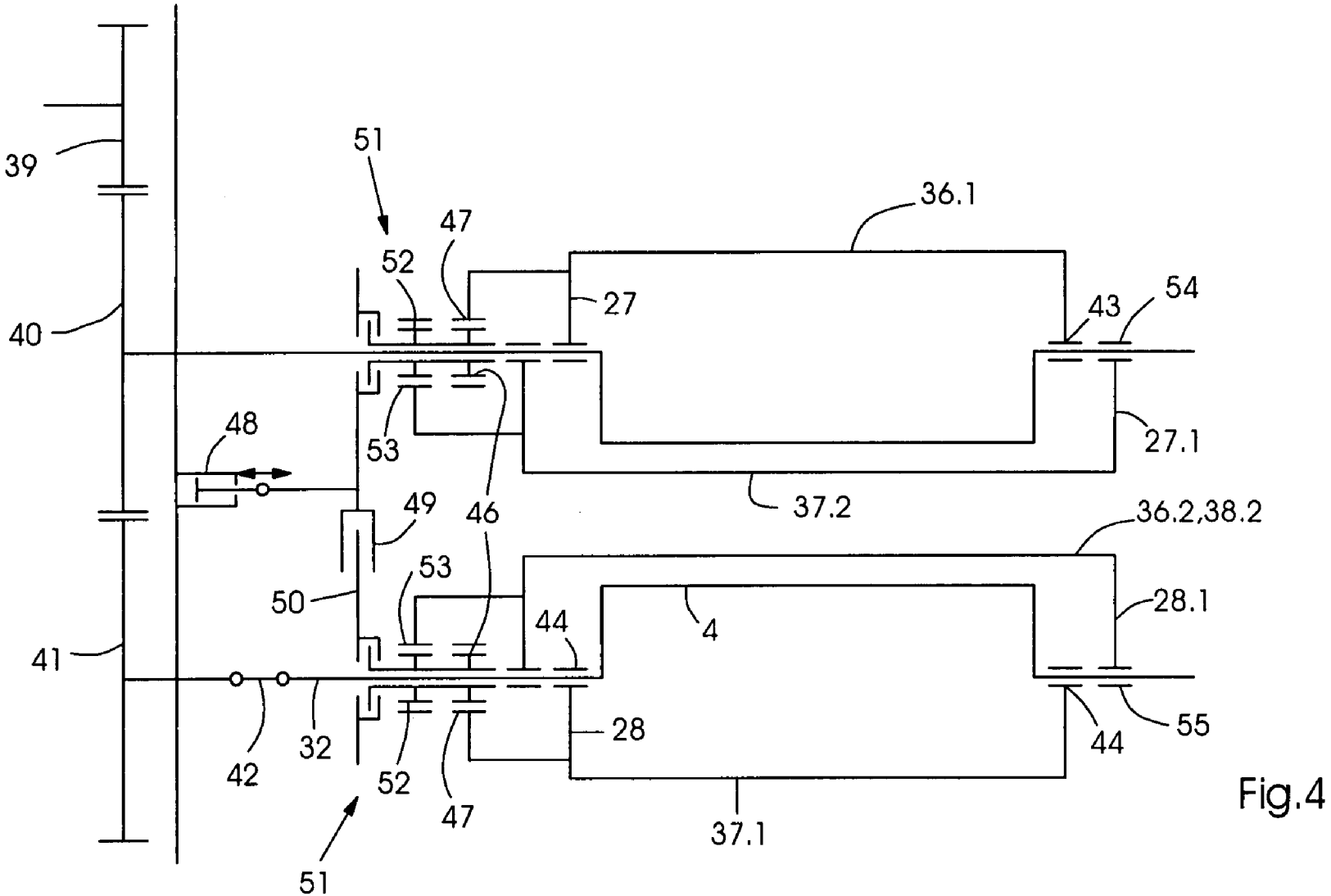
FIG. 4 is a view similar to that of FIG. 3 of another embodiment of the invention wherein there is shown the kinematics of the drive for two perforating bars which are respectively accommodated on the periphery of each of the cylinders of the perforating-cylinder pair.

FIG. 4 shows the kinematics of a perforating-cylinder pair, two perforating bars 27, 27.1 and 28, 28.1 being constructed on each of the cylinders 3 and 4. The perforating bars 27, 27.1, 28 and 28.1 are all accommodated in mounting supports 43, 44 and 54, 55 on the respective cylinder shafts 31 and 32. Differentiating from the exemplary embodiment according to FIG. 3, on the transmission elements 51 illustrated in FIG. 4, there are two external toothing systems 46 and 52, which cooperate with respectively corresponding toothing systems 47 and 53 on the perforating bars 27, 27.1, as well as 28 and 28.1.

Provision is made for an adjusting unit 48 which is assigned to both coulisses or slotted guides, analogous to the embodiment according to FIG. 3, the adjusting unit acting upon the transmission elements 51, which it jointly adjusts, a compensating unit 49 already described above in connection with FIG. 3 being integrated into the sliding guide 50.

In the exemplary embodiment according to FIG. 4, the perforating strips 36.2, 37.2 and 38.2 stationarily accommodated in FIG. 2 on the periphery 33, 34 of the respective perforating cylinders 3 and 4 are likewise mounted on perforating bars 27.1 and 28.1, so that the latter are likewise adjustable in the peripheral direction relative to the peripheral surfaces of the perforating cylinders 3 and 4, so that simultaneous movement of the perforating strips 36.2, 37.2 and 38.2 and the perforating tools 36.1, 37.1 and 38.1 is possible.

What is claimed is:

1. A device for perforating material webs, comprising:

a pair of perforating cylinders defining a perforation nip therebetween for passage of the material webs through said perforating nip, one of said perforating cylinders being adjustable in relation to said perforating nip relative to the other of said perforating cylinders;

perforating tools capable of producing perforations on copies in an exactly correct position with respect to cross-folds formed in the copies, the perforation position being adjustable during machine operation;

perforating strips, said perforating tools each being cooperatively related with a respective one of said perforating strips for producing transverse or cross-perforations and being adjustable in the correct position relative to the cross-folds;

at least one bridge-shaped perforating bar exteriorly straddling a respective one of said perforating cylinders, said at least one bridge-shaped perforating bar adjustable fixed to an axis of said respective one of said perforating cylinders, some of said perforating tools and said perforating strips being accommodated on said at least one perforating bar, others of said perforating tools and said perforating strips being accommodated directly on said cylinders; and an adjusting unit for adjusting said at least one perforating bar relative to a periphery of said respective one of said perforating cylinders.

2. The perforating device according to claim 1, wherein said at least one perforating bar is mounted on a cylinder shaft extending through said respective one of said perforating cylinders.

3. The perforating device according to claim 1, wherein one of said at least one perforating bar is adjustable in a direction opposite to a direction of rotation of said respective one of said perforating cylinders.

4. The perforating device according to claim 1, wherein one of said perforating tools and one of said perforating strips are accommodated stationarily on said periphery of said respective one of said perforating cylinders.

5. The perforating device according to claim 1, wherein one of said perforating tools used for a delta-folding mode is accommodated on one of said at least one perforating bar on one perforating cylinder, and is cooperatively related with one of said perforating strips accommodated on the other perforating cylinder located opposite said one perforating cylinder.

6. The perforating device according to claim 1, wherein said perforating cylinders have respective cylinder shafts, the perforating device includes mounting supports on said cylinder shafts, said perforating bars are accommodated in said mounting supports.

7. The perforating device according to claim 1, wherein said pair of perforating cylinders include a stationarily mounted perforating cylinder and an adjustable perforating cylinder, the perforating device includes a drive and a transmission element for said adjustable perforating cylinder, and an articulated connection between said drive and said transmission element.

8. The perforating device according to claim 1, wherein one of said perforating tools is accommodated on one of said at least one perforating bar on one perforating cylinder, and is cooperatively related with one of said perforating strips accommodated on the other perforating cylinder located opposite said one perforating cylinder.

9. The perforating device according to claim 8, wherein one of said perforating tools is accommodated on one of said at least one perforating bar on said other perforating cylinder, and is cooperatively related with one of said perforating strips accommodated stationarily on said periphery on said one perforating cylinder located opposite said other perforating cylinder.

10. The perforating device according to claim 1, wherein the perforating strips are mounted on further perforating bars extending coaxially with respect to the perforating cylinders, and adjustable relative thereto.

11. The perforating device according to claim 1, wherein said perforating cylinders have respective cylinder shafts and transmission elements on said cylinder shafts, said transmission elements to be acted upon by said adjusting unit.

12. The perforating device according to claim 11, wherein said transmission elements are constructed as a coulisse or slotted guide.

13. The perforating device according to claim 11, including, between said transmission elements of said perforating cylinders, a compensating device for permitting eccentric adjustment of one of said perforating cylinders relative to said perforating nip.

14. The perforating device according to claim 11, wherein said transmission elements have at least one force transmission point.

15. The perforating device according to claim 14, wherein said at least one force transmission point is constructed as a toothing.

16. A folder having a device for perforating material webs, the device comprising:

a pair of perforating cylinders defining a perforation nip therebetween for passage of the material webs through said perforating nip, one of said perforating cylinders being adjustable in relation to said perforating nip relative to the other of said perforating cylinders;

perforating tools capable of producing perforations on copies in an exactly correct position with respect to cross-folds formed in the copies, the perforation position being adjustable during machine operation;

perforating strips said perforating tools being cooperatively related with respective one of said perforating strips for producing transverse or cross-perforations and being adjustable in the correct position relative to the cross-folds;

at least one bridge-shaped perforating bar exteriorly straddling a respective one of said perforating cylinders, said at least one bridge-shaped perforating bar adjustably fixed to an axis of said respective one of said perforating cylinders, some of said perforating tools and said perforating strips being accommodated on said at least one perforating bar, others of said perforating tools and said perforating strips being accommodated directly on said cylinders; and an adjusting unit for adjusting said at least one perforating bar relative to a periphery of said respective one of said perforating cylinders.

17. A pin-less folder having a device for perforating material webs, the device comprising:

a pair of perforating cylinders defining a perforation nip therebetween for passage of the material webs through said perforating nip, one of said perforating cylinders being adjustable in relation to said perforating nip relative to the other of said perforating cylinders;

perforating tools capable of producing perforations on copies in an exactly correct position with respect to cross-folds formed in the copies, the perforation position being adjustable during machine operation;

perforating strips said perforating tools being cooperatively related with respective one of said perforating strips for producing transverse or cross-perforations and being adjustable in the correct position relative to the cross-folds;

at least one bridge-shaped perforating bar exteriorly straddling a respective one of said perforating cylinders, said at least one bridge-shaped perforating bar adjustably fixed to an axis of said respective one of said perforating cylinders, some of said perforating tools and said perforating strips being accommodated on said at least one perforating bar, others of said perforating tools and said perforating strips being accommodated directly on said cylinders; and an adjusting unit for adjusting said at least one perforating bar relative to a periphery of said respective one of said perforating cylinders.

* * * * *